US008397800B2

(12) United States Patent
Rodgers et al.

(10) Patent No.: US 8,397,800 B2
(45) Date of Patent: Mar. 19, 2013

(54) PERFORATING STRING WITH LONGITUDINAL SHOCK DE-COUPLER

(75) Inventors: John P. Rodgers, Roanoke, TX (US); John D. Burleson, Denton, TX (US); Marco Serra, Winterhur (CH); Timothy S. Glenn, Dracut, MA (US); Edwin A. Eaton, Grapevine, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/325,866

(22) Filed: Dec. 14, 2011

(65) Prior Publication Data

US 2012/0152615 A1 Jun. 21, 2012

(30) Foreign Application Priority Data

| | | |
|---|---|---|
| Dec. 17, 2010 | (WO) | PCT/US10/61104 |
| Apr. 29, 2011 | (WO) | PCT/US11/34690 |
| Aug. 8, 2011 | (WO) | PCT/US11/46955 |
| Sep. 2, 2011 | (WO) | PCT/US11/50395 |

(51) Int. Cl.
*E21B 43/11* (2006.01)
*E21B 17/07* (2006.01)

(52) U.S. Cl. ..... 166/55; 166/178; 166/242.1; 166/297; 175/2

(58) Field of Classification Search ..... 166/297, 166/377, 55, 168, 178, 242.1; 175/2
See application file for complete search history.

(56) References Cited

U.S. PATENT DOCUMENTS

| | | | |
|---|---|---|---|
| 2,833,213 | A | 5/1958 | Udry |
| 2,980,017 | A | 4/1961 | Castel |
| 3,057,296 | A | 10/1962 | Silverman |
| 3,128,825 | A | 4/1964 | Blagg |
| 3,143,321 | A | 8/1964 | McGehee et al. |
| 3,208,378 | A | 9/1965 | Boop |
| 3,216,751 | A | 11/1965 | Der Mott |
| 3,394,612 | A | 7/1968 | Bogosoff et al. |
| 3,414,071 | A | 12/1968 | Alberts |
| 3,653,468 | A | 4/1972 | Marshall |
| 3,687,074 | A | 8/1972 | Andrews et al. |

(Continued)

FOREIGN PATENT DOCUMENTS

| | | | |
|---|---|---|---|
| EP | 2065557 | A1 | 6/2009 |
| WO | 2004099564 | A2 | 11/2004 |

OTHER PUBLICATIONS

IES, Scott A. Ager; "IES Housing and High Shock Considerations", informational presentation, Sep. 1, 2010, 18 pages.

(Continued)

*Primary Examiner* — Jennifer H Gay
(74) *Attorney, Agent, or Firm* — Smith IP Services, P.C.

(57) ABSTRACT

A shock de-coupler for use with a perforating string can include perforating string connectors at opposite ends of the de-coupler, a longitudinal axis extending between the connectors, and a biasing device which resists displacement of one connector relative to the other connector in both opposite directions along the longitudinal axis, whereby the first connector is biased toward a predetermined position relative to the second connector. A perforating string can include a shock de-coupler interconnected longitudinally between components of the perforating string, with the shock de-coupler variably resisting displacement of one component away from a predetermined position relative to the other component in each longitudinal direction, and in which a compliance of the shock de-coupler substantially decreases in response to displacement of the first component a predetermined distance away from the predetermined position relative to the second component.

5 Claims, 8 Drawing Sheets

U.S. PATENT DOCUMENTS

| | | | | |
|---|---|---|---|---|
| 3,779,591 | A | 12/1973 | Rands | |
| 3,923,105 | A * | 12/1975 | Lands, Jr. | 175/4.55 |
| 3,923,106 | A | 12/1975 | Bosse-Platiere | |
| 3,923,107 | A | 12/1975 | Dillard | |
| 3,971,926 | A | 7/1976 | Gau et al. | |
| 4,269,063 | A | 5/1981 | Escaron et al. | |
| 4,319,526 | A | 3/1982 | DerMott | |
| 4,346,795 | A | 8/1982 | Herbert | |
| 4,409,824 | A | 10/1983 | Salama et al. | |
| 4,410,051 | A | 10/1983 | Daniel et al. | |
| 4,419,933 | A | 12/1983 | Kirby et al. | |
| 4,480,690 | A | 11/1984 | Vann | |
| 4,575,026 | A | 3/1986 | Brittain et al. | |
| 4,598,776 | A | 7/1986 | Stout | |
| 4,612,992 | A | 9/1986 | Vann et al. | |
| 4,619,333 | A | 10/1986 | George | |
| 4,637,478 | A | 1/1987 | George | |
| 4,679,669 | A | 7/1987 | Kalb et al. | |
| 4,693,317 | A | 9/1987 | Edwards et al. | |
| 4,694,878 | A * | 9/1987 | Gambertoglio | 166/377 |
| 4,764,231 | A | 8/1988 | Slawinski et al. | |
| 4,817,710 | A | 4/1989 | Edwards et al. | |
| 4,830,120 | A | 5/1989 | Stout | |
| 4,842,059 | A | 6/1989 | Tomek | |
| 4,901,802 | A | 2/1990 | George et al. | |
| 4,913,053 | A | 4/1990 | McPhee | |
| 4,971,153 | A | 11/1990 | Rowe et al. | |
| 5,027,708 | A | 7/1991 | Gonzalez et al. | |
| 5,044,437 | A | 9/1991 | Wittrisch | |
| 5,078,210 | A | 1/1992 | George | |
| 5,088,557 | A | 2/1992 | Ricles et al. | |
| 5,092,167 | A | 3/1992 | Finley et al. | |
| 5,103,912 | A | 4/1992 | Flint | |
| 5,107,927 | A | 4/1992 | Whiteley et al. | |
| 5,109,355 | A | 4/1992 | Yuno | |
| 5,117,911 | A | 6/1992 | Navarette et al. | |
| 5,131,470 | A * | 7/1992 | Miszewski et al. | 166/297 |
| 5,133,419 | A | 7/1992 | Barrington | |
| 5,161,616 | A | 11/1992 | Colla | |
| 5,188,191 | A | 2/1993 | Tomek | |
| 5,216,197 | A | 6/1993 | Huber et al. | |
| 5,287,924 | A | 2/1994 | Burleson et al. | |
| 5,343,963 | A | 9/1994 | Bouldin et al. | |
| 5,351,791 | A | 10/1994 | Rosenzweig | |
| 5,366,013 | A | 11/1994 | Edwards et al. | |
| 5,421,780 | A | 6/1995 | Vukovic | |
| 5,529,127 | A | 6/1996 | Burleson et al. | |
| 5,547,148 | A | 8/1996 | Del Monte et al. | |
| 5,598,894 | A | 2/1997 | Burleson et al. | |
| 5,603,379 | A | 2/1997 | Henke et al. | |
| 5,662,166 | A | 9/1997 | Shammai | |
| 5,667,023 | A | 9/1997 | Harrell et al. | |
| 5,774,420 | A | 6/1998 | Heysse et al. | |
| 5,813,480 | A | 9/1998 | Zaleski, Jr. et al. | |
| 5,823,266 | A * | 10/1998 | Burleson et al. | 166/380 |
| 5,826,654 | A | 10/1998 | Adnan et al. | |
| 5,957,209 | A * | 9/1999 | Burleson et al. | 166/380 |
| 5,964,294 | A | 10/1999 | Edwards et al. | |
| 5,992,523 | A * | 11/1999 | Burleson et al. | 166/297 |
| 6,012,015 | A | 1/2000 | Tubel | |
| 6,021,377 | A | 2/2000 | Dubinsky et al. | |
| 6,068,394 | A | 5/2000 | Dublin, Jr. | |
| 6,078,867 | A | 6/2000 | Plumb et al. | |
| 6,098,716 | A * | 8/2000 | Hromas et al. | 166/377 |
| 6,135,252 | A | 10/2000 | Knotts | |
| 6,173,779 | B1 | 1/2001 | Smith | |
| 6,216,533 | B1 | 4/2001 | Woloson et al. | |
| 6,230,101 | B1 | 5/2001 | Wallis | |
| 6,283,214 | B1 | 9/2001 | Guinot et al. | |
| 6,308,809 | B1 | 10/2001 | Reid et al. | |
| 6,371,541 | B1 | 4/2002 | Pedersen | |
| 6,394,241 | B1 | 5/2002 | Desjardins et al. | |
| 6,397,752 | B1 | 6/2002 | Yang et al. | |
| 6,408,953 | B1 | 6/2002 | Goldman et al. | |
| 6,412,415 | B1 | 7/2002 | Kothari et al. | |
| 6,412,614 | B1 | 7/2002 | Lagrange et al. | |
| 6,450,022 | B1 | 9/2002 | Brewer | |
| 6,454,012 | B1 | 9/2002 | Reid | |
| 6,457,570 | B2 | 10/2002 | Reid et al. | |
| 6,484,801 | B2 | 11/2002 | Brewer et al. | |
| 6,543,538 | B2 | 4/2003 | Tolman et al. | |
| 6,550,322 | B2 | 4/2003 | Sweetland et al. | |
| 6,595,290 | B2 | 7/2003 | George et al. | |
| 6,672,405 | B2 | 1/2004 | Tolman et al. | |
| 6,674,432 | B2 | 1/2004 | Kennon et al. | |
| 6,679,323 | B2 | 1/2004 | Vargervik et al. | |
| 6,679,327 | B2 | 1/2004 | Sloan et al. | |
| 6,684,949 | B1 | 2/2004 | Gabler et al. | |
| 6,684,954 | B2 | 2/2004 | George | |
| 6,708,761 | B2 | 3/2004 | George et al. | |
| 6,810,370 | B1 | 10/2004 | Watts, III | |
| 6,826,483 | B1 | 11/2004 | Anderson | |
| 6,832,159 | B2 | 12/2004 | Smits et al. | |
| 6,842,725 | B1 | 1/2005 | Sarda | |
| 6,868,920 | B2 | 3/2005 | Hoteit et al. | |
| 7,000,699 | B2 | 2/2006 | Yang et al. | |
| 7,006,959 | B1 | 2/2006 | Huh et al. | |
| 7,044,219 | B2 | 5/2006 | Mason et al. | |
| 7,114,564 | B2 | 10/2006 | Parrott et al. | |
| 7,121,340 | B2 | 10/2006 | Grove et al. | |
| 7,139,689 | B2 | 11/2006 | Huang | |
| 7,147,088 | B2 | 12/2006 | Reid et al. | |
| 7,165,612 | B2 | 1/2007 | McLaughlin | |
| 7,178,608 | B2 | 2/2007 | Mayes et al. | |
| 7,234,517 | B2 | 6/2007 | Streich et al. | |
| 7,246,659 | B2 | 7/2007 | Fripp et al. | |
| 7,260,508 | B2 | 8/2007 | Lim et al. | |
| 7,278,480 | B2 | 10/2007 | Longfield et al. | |
| 7,387,160 | B2 | 6/2008 | O'Shaughnessy et al. | |
| 7,503,403 | B2 | 3/2009 | Jogi et al. | |
| 7,509,245 | B2 | 3/2009 | Siebrits et al. | |
| 7,533,722 | B2 | 5/2009 | George et al. | |
| 7,600,568 | B2 | 10/2009 | Ross et al. | |
| 7,603,264 | B2 | 10/2009 | Zamora et al. | |
| 7,640,986 | B2 | 1/2010 | Behrmann et al. | |
| 7,721,650 | B2 | 5/2010 | Barton et al. | |
| 7,721,820 | B2 | 5/2010 | Hill et al. | |
| 7,762,331 | B2 | 7/2010 | Goodman et al. | |
| 7,770,662 | B2 | 8/2010 | Harvey et al. | |
| 8,126,646 | B2 | 2/2012 | Grove et al. | |
| 8,136,608 | B2 | 3/2012 | Goodman | |
| 2002/0121134 | A1 | 9/2002 | Sweetland et al. | |
| 2003/0062169 | A1 * | 4/2003 | Marshall | 166/377 |
| 2003/0089497 | A1 * | 5/2003 | George et al. | 166/297 |
| 2003/0150646 | A1 | 8/2003 | Brooks et al. | |
| 2004/0045351 | A1 | 3/2004 | Skinner | |
| 2004/0104029 | A1 | 6/2004 | Martin | |
| 2004/0140090 | A1 * | 7/2004 | Mason et al. | 166/242.1 |
| 2006/0070734 | A1 | 4/2006 | Zillinger et al. | |
| 2006/0118297 | A1 | 6/2006 | Finci et al. | |
| 2006/0243453 | A1 | 11/2006 | McKee | |
| 2007/0101808 | A1 | 5/2007 | Irani et al. | |
| 2007/0162235 | A1 | 7/2007 | Zhan et al. | |
| 2007/0193740 | A1 | 8/2007 | Quint | |
| 2007/0214990 | A1 | 9/2007 | Barkley et al. | |
| 2008/0041597 | A1 * | 2/2008 | Fisher et al. | 166/381 |
| 2008/0149338 | A1 | 6/2008 | Goodman et al. | |
| 2008/0202325 | A1 | 8/2008 | Bertoja et al. | |
| 2008/0216554 | A1 | 9/2008 | McKee | |
| 2008/0245255 | A1 | 10/2008 | Barton et al. | |
| 2008/0262810 | A1 | 10/2008 | Moran et al. | |
| 2008/0314582 | A1 | 12/2008 | Belani et al. | |
| 2009/0013775 | A1 | 1/2009 | Bogath et al. | |
| 2009/0071645 | A1 | 3/2009 | Kenison et al. | |
| 2009/0084535 | A1 | 4/2009 | Bertoja et al. | |
| 2009/0151589 | A1 | 6/2009 | Henderson et al. | |
| 2009/0159284 | A1 | 6/2009 | Goodman | |
| 2009/0182541 | A1 | 7/2009 | Crick et al. | |
| 2009/0223400 | A1 | 9/2009 | Hill et al. | |
| 2009/0241658 | A1 | 10/2009 | Irani et al. | |
| 2009/0272529 | A1 | 11/2009 | Crawford | |
| 2009/0276156 | A1 | 11/2009 | Kragas et al. | |
| 2009/0294122 | A1 | 12/2009 | Hansen et al. | |
| 2010/0000789 | A1 | 1/2010 | Barton et al. | |
| 2010/0037793 | A1 | 2/2010 | Lee et al. | |
| 2010/0085210 | A1 | 4/2010 | Bonavides et al. | |
| 2010/0132939 | A1 | 6/2010 | Rodgers | |

| | | | | |
|---|---|---|---|---|
| 2010/0133004 | A1 | 6/2010 | Burleson et al. | |
| 2010/0147519 | A1 | 6/2010 | Goodman | |
| 2012/0085539 | A1* | 4/2012 | Tonnessen et al. | 166/298 |
| 2012/0152614 | A1* | 6/2012 | Rodgers et al. | 175/2 |
| 2012/0152615 | A1* | 6/2012 | Rodgers et al. | 175/2 |

OTHER PUBLICATIONS

IES, Scott A. Ager; Analog Recorder Test Example, informational letter, dated Sep. 1, 2010, 1 page.
IES, Scott A. Ager; "Series 300 Gauge", product information, dated Sep. 1, 2010, 1 page.
IES, Scott A. Ager; "IES Introduction", Company introduction presentation, received Sep. 1, 2010, 23 pages.
Petroleum Experts; "IPM: Engineering Software Development", product brochure, dated 2008, 27 pages.
International Search Report with Written Opinion issued Oct. 27, 2011 for PCT Patent Application No. PCT/US11/034690, 9 pages.
Kappa Engineering; "Petroleum Exploration and Product Software, Training and Consulting", product informational paper on v4.12B, dated Jan. 2010, 48 pages.
Qiankun Jin, Zheng Shigui, Gary Ding, Yianjun, Cui Binggui, Beijing Engeneering Software Technology Co. Ltd.; "3D Numerical Simulations of Penetration of Oil-Well Perforator into Concrete Targets", Paper for the 7th International LS-DYNA Users Conference, Jan. 28, 2010, 6 pages.
Mario Dobrilovic, Zvonimir Ester, Trpimir Kujundzic; "Measurments of Shock Wave Force in Shock Tube with Indirect Methods", Original scientific paper vol. 17, str. 55-60, dated 2005, 6 pages.
IES, Scott A. Ager; "Model 64 and 74 Buildup", product presentation, dated Oct. 17, 2006,57 pages.
Halliburton; "AutoLatch Release Gun Connector", Special Applications 6-7, Jan. 19, 2011, 1 page.
Halliburton; "Body Lock Ring", Mechanical Downhole: Technology Transfer, dated Oct. 10, 2001, 4 pages.
Starboard Innovations, LLC; "Downhole Mechanical Shock Absorber", patent and prior art search results, Preliminary Report, dated Jul. 8, 2010, 22 pages.
Carlos Baumann, Harvey Williams, and Schlumberger; "Perforating Wellbore Dynamics and Gunshock in Deepwater TCP Operations", Product informational presentation, IPS-10-018, May 11, 2011, 28 pages.
Schlumberger; "SXVA Explosively Initiated Vertical Shock Absorber", product paper 06-WT-066, dated 2007, 1 page.
International Search Report with Written Opinion issued Dec. 27, 2011 for PCT Patent Application No. PCT/US11/046955, 8 pages.
International Search Report with Written Opinion issued Jul. 28, 2011 for International Application No. PCT/US10/61104, 8 pages.
International Search Report with Written Opinion issued Nov. 22, 2011 for International Application No. PCT/US11/029412, 9 pages.
International Search Report with Written Opinion issued Jul. 28, 2011 for International Application No. PCT/US10/061107, 9 pages.
International Search Report with Written Opinion issued Oct. 27, 2011 for International Application No. PCT/US11/034690, 9 pages.
Office Action issued Sep. 8, 2009, for U.S. Appl. No. 11/957,541, 10 pages.
Office Action issued Feb. 2, 2010, for U.S. Appl. No. 11/957,541, 8 pages.
Office Action issued Jul. 15, 2010, for U.S. Appl. No. 11/957,541, 6 pages.
Office Action issued Nov. 22, 2010, for U.S. Appl. No. 11/957,541, 6 pages.
Office Action issued May 4, 2011, for U.S. Appl. No. 11/957,541, 9 pages.
Office Action issued Apr. 21, 2011, for U.S. Appl. No. 13/008,075, 9 pages.
J.A. Regalbuto et al; "Computer Codes for Oilwell-Perforator Design", SPE 30182, dated Sep. 1997, 8 pages.
J.F. Schatz et al; "High-Speed Downhole Memory Recorder and Software Used to Design and Confirm Perforating/Propellant Behavior and Formation Fracturing", SPE 56434, dated Oct. 3-6, 1999, 9 pages.
Joseph Ansah et al; "Advances in Well Completion Design: A New 3D Finite-Element Wellbore Inflow Model for Optimizing Performance of Perforated Completions", SPE 73760, Feb. 20-21, 2002, 11 pages.
D.A. Cuthill et al; "A New Technique for Rapid Estimation of Fracture Closure Stress When Using Propellants", SPE 78171, dated Oct. 20-23, 2002, 6 pages.
J.F. Schatz et al; "High-Speed Pressure and Accelerometer Measurements Characterize Dynamic Behavior During Perforating Events in Deepwater Gulf of Mexico", SPE 90042, dated Sep. 26-29, 2004, 15 pages.
Liang-Biao Ouyang et al; "Case Studies for Improving Completion Design Through Comprehensive Well-Performance Modeling", SPE 104078, dated Dec. 5-7, 2006, 11 pages.
Liang-Biao Ouyang et al; "Uncertainty Assessment on Well-Performance Prediction for an Oil Producer Equipped With Selected Completions", SPE 106966, dated Mar. 31-Apr. 3, 2007, 9 pages.
B. Grove et al; "new Effective Stress Law for Predicting Perforation Depth at Downhole Conditions", SPE 111778, dated Feb. 13-15, 2008, 10 pages.
Search Report issued Feb. 17, 2012 for International Application No. PCT/US11/50395, 5 pages.
Written Opinion issued Feb. 17, 2012 for International Application No. PCT/US11/50395, 4 pages.
International Search Report with Written Opinion issued Nov. 30, 2011 for PCT/US11/036686, 10 pages.
Office Action issued Jan. 27, 2012 for U.S. Appl. No. 13/210,303, 32 pages.
International Search Report with Written Opinion issued Feb. 9, 2012 for PCT/US11/050401, 8 pages.
Office Action issued Feb. 24, 2012 for U.S. Appl. No. 13/304,075, 15 pages.
Office Action issued Jun. 6, 2012 for U.S. Appl. No. 13/325,909, 35 pages.
Office Action issued Jun. 7, 2012 for U.S. Appl. No. 13/430,550, 21 pages.
Office Action issued Sep. 6, 2012 for U.S. Appl. No. 13/495,035, 28 pages.
Office Action issued Oct. 1, 2012 for U.S. Appl. No. 13/325,726, 20 pages.
Specification and drawing for U.S. Appl. No. 13/585,846, filed Aug. 25, 2012, 45 pages.
Kenji Furui; "A Comprehensive Skin Factor Model for Well Completions Based on Finite Element Simulations", informational paper, dated May 2004, 182 pages.
Office Action issued Apr. 10, 2012 for U.S. Appl. No. 13/325,726, 26 pages.
Scott A. Ager; "IES Fast Speed Gauges", informational presentation, date Mar. 2, 2009, 38 pages.
IES; "Battery Packing for High Shock", article AN102, received Sep. 1, 2010, 4 pages.
IES; "Accelerometer Wire Termination", article AN106, received Sep. 1, 2010, 4 pages.
John F. Schatz; "PulsFrac Validation: Owen/HTH Surface Block Test", product information, dated 2004, 4 pages.
John F. Schatz; "Casing Differential in PulsFrac Calculations", product information, dated 2004, 2 pages.
John F. Schatz; "The Role of Compressibility in PulsFrac Software", informational paper, dated Aug. 22, 2007, 2 pages.
Essca Group; "Erin Dynamic Flow Analysis Platform", online article, dated 2009, 1 page.
Halliburton; "Fast Gauge Recorder", article 5-110, Nov. 16, 2010, 2 pages.
Halliburton; "Simulation Software for EquiFlow ICD Completions", H07010, dated Sep. 2009, 2 pages.
Patent Application and drawing for U.S. Appl. No. 13/413,588, filed Mar. 6, 2012, 30 pages.
Patent Application and drawing for U.S. Appl. No. 13/078,423, filed Apr. 1, 2011, 42 pages.
Offshore Technology Conference; "Predicting Pressure Behavior and Dynamic Shock Loads on Completion Hardware During Perforating", OTC 21059, dated May 3-6, 2010, 11 pages.

IES; "Series 200: High Shock, High Speed Pressure and Acceleration Gauge", product brochure, Feb. 11, 2010, 2 pages.
Terje Rudshaug, et al.; "A toolbox for improved Reservoir Management", NETool, Force AWTC Seminar, Apr. 21-22, 2004, 29 pages.
Halliburton; "ShockPro Schockload Evaluation Service", Perforating Solutions pp. 5-125 to 5-126, dated 2007, 2 pages.
Halliburton; "ShockPro Schockload Evaluation Service", H03888, dated Jul. 2007, 2 pages.
Strain Gages; "Positioning Strain Gages to Monitor Bending, Axial, Shear, and Torsional Loads", pp. E-5 to E-6, dated 2012, 2 pages.
B. Grove, et al.; "Explosion-Induced Damage to Oilwell Perforating Gun Carriers", Structures Under Shock and Impact IX, vol. 87, ISSN 1743-3509, SU060171, dated 2006, 12 pages.
WEM; "Well Evaluation Model", product brochure, Mar. 2, 2010, 2 pages.
Endevco; "Problems in High-Shock Measurement", MEGGITT brochure TP308, dated Jul. 2007, 9 pages.
Specification and Drawings for U.S. Appl. No. 13/495,035, filed Jun. 13, 2012, 37 pages.
Specification and Drawings for U.S Appl. No. 13/493,327, filed Jun. 11, 2012, 30 pages.
"2010 International Perforating Symposium", Agenda, dated May 6-7, 2010, 2 pages.
A. Blakeborough et al.; "Novel Load Cell for Measuring Axial Forca, Shear Force, and Bending Movement in large-scale Structural Experiments", Informational paper, dated Mar. 23-Aug. 30, 2001, 8 pages.
Weibing Li et al.; "The Effect of Annular Multi-Point Initiation on the Formation and Penetration of an Explosively Formed Penetrator", Article in the International Journal of Impact Engineering, dated Aug. 27, 2009, 11 pages.
Sergio Murilo et al.; "Optimization and Automation of Modeling of Flow Perforated Oil Wells", Presentation for the Product Development Conference, dated 2004, 31 pages.
Frederic Bruyere et al.; "New Practices to Enhance Perforating Results", Oilfield Review, dated Autumn 2006, 18 pages.
John F. Schatz; "Pert Breakdown, Fracturing, and Cleanup in PulsFrac", informational brochure, dated May 2, 2007, 6 pages.
M. A. Proett et al.; "Productivity Optimization of Oil Wells Using a New 3D Finite-Element Wellbore Inflow Model and Artificial Neutral Network", conference paper, dated 2004, 17 pages.
John F. Schatz; "PulsFrac Summary Technical Description", informational brochure, dated 2003, 8 pages.
IES, Scott A. Ager; "IES Recorder Buildup", Company presentation, Sep. 1, 2010, 59 pages.
IES, Scott A. Ager; "IES Sensor Discussion", Sep. 1, 2010, 38 pages.
IES; "Series 300: High Shock, High Speed Pressure Gauge", product brochure, dated Feb. 1, 2012, 2 pages.
Australian Office Action issued Sep. 21, 2012 for AU Patent Application No. 2010365400, 3 pages.
Office Action issued Dec. 12, 2012 for U.S. Appl. No. 13/493,327, 75 pages.
Office Action issued Dec. 14, 2012 for U.S. Appl. No. 13/495,035, 19 pages.
Office Action issued Dec. 18, 2012 for U.S. Appl. No. 13/533,600, 48 pages.
Office Action issued Nov. 19, 2012 for U.S. Appl. No. 13/325,909, 43 pages.

* cited by examiner

PERFORATING STRING WITH LONGITUDINAL SHOCK DE-COUPLER

CROSS-REFERENCE TO RELATED APPLICATIONS

This application claims the benefit under 35 USC §119 of the filing date of International Application Serial No. PCT/US11/50395 filed 2 Sep. 2011, International Application Serial No. PCT/US11/46955 filed 8 Aug. 2011, International Patent Application Serial No. PCT/US11/34690 filed 29 Apr. 2011, and International Patent Application Serial No. PCT/US10/61104 filed 17 Dec. 2010. The entire disclosures of these prior applications are incorporated herein by this reference.

BACKGROUND

The present disclosure relates generally to equipment utilized and operations performed in conjunction with a subterranean well and, in an embodiment described herein, more particularly provides for mitigating shock produced by well perforating.

Shock absorbers have been used in the past to absorb shock produced by detonation of perforating guns in wells. Unfortunately, prior shock absorbers have had only very limited success. In part, the present inventors have postulated that this is due to the prior shock absorbers being incapable of reacting sufficiently quickly to allow some displacement of one perforating string component relative to another during a shock event.

Therefore, it will be appreciated that improvements are needed in the art of mitigating shock produced by well perforating.

SUMMARY

In carrying out the principles of this disclosure, a shock de-coupler is provided which brings improvements to the art of mitigating shock produced by perforating strings. One example is described below in which a shock de-coupler is initially relatively compliant, but becomes more rigid when a certain amount of displacement has been experienced due to a perforating event. Another example is described below in which the shock de-coupler permits displacement in both longitudinal directions, but the de-coupler is "centered" for precise positioning of perforating string components in a well.

In one aspect, a shock de-coupler for use with a perforating string is provided to the art by this disclosure. In one example, the de-coupler can include perforating string connectors at opposite ends of the de-coupler, with a longitudinal axis extending between the connectors. At least one biasing device resists displacement of one connector relative to the other connector in each opposite direction along the longitudinal axis, whereby the first connector is biased toward a predetermined position relative to the second connector.

In another aspect, a perforating string is provided by this disclosure. In one example, the perforating string can include a shock de-coupler interconnected longitudinally between two components of the perforating string. The shock de-coupler variably resists displacement of one component away from a predetermined position relative to the other component in each longitudinal direction, and a compliance of the shock de-coupler substantially decreases in response to displacement of the first component a predetermined distance away from the predetermined position relative to the second component.

These and other features, advantages and benefits will become apparent to one of ordinary skill in the art upon careful consideration of the detailed description of representative embodiments of the disclosure hereinbelow and the accompanying drawings, in which similar elements are indicated in the various figures using the same reference numbers.

DETAILED DESCRIPTION

Figure 1:
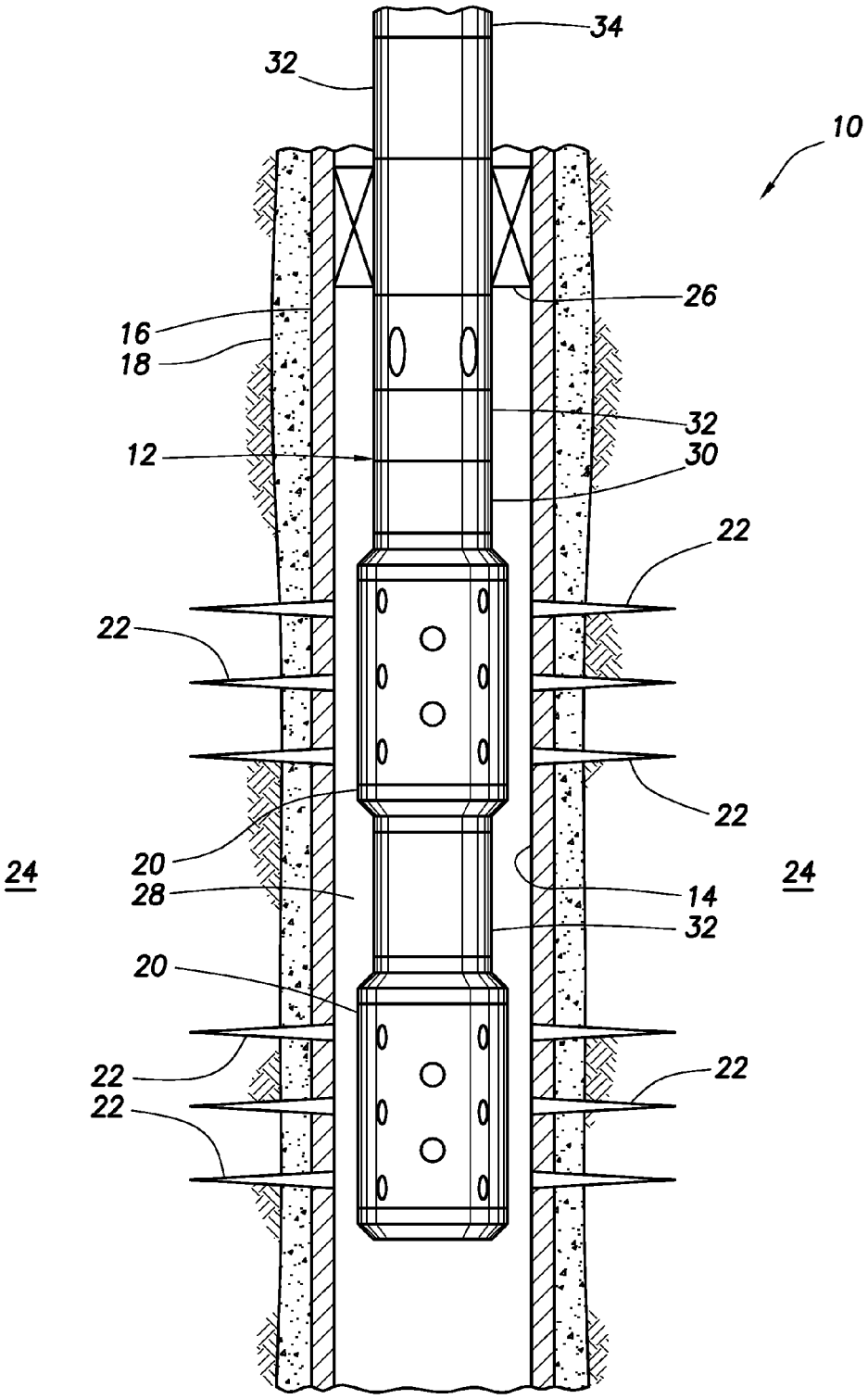
FIG. 1 is a representative partially cross-sectional view of a well system and associated method which can embody principles of this disclosure.

Representatively illustrated in FIG. 1 is a well system 10 and associated method which can embody principles of this disclosure. In the system 10, a perforating string 12 is positioned in a wellbore 14 lined with casing 16 and cement 18. Perforating guns 20 in the perforating string 12 are positioned opposite predetermined locations for forming perforations 22 through the casing 16 and cement 18, and outward into an earth formation 24 surrounding the wellbore 14.

The perforating string 12 is sealed and secured in the casing 16 by a packer 26. The packer 26 seals off an annulus 28 formed radially between the tubular string 12 and the wellbore 14.

A firing head 30 is used to initiate firing or detonation of the perforating guns 20 (e.g., in response to a mechanical, hydraulic, electrical, optical or other type of signal, passage of time, etc.), when it is desired to form the perforations 22. Although the firing head 30 is depicted in FIG. 1 as being connected above the perforating guns 20, one or more firing heads may be interconnected in the perforating string 12 at any location, with the location(s) preferably being connected to the perforating guns by a detonation train.

In the example of FIG. 1, shock de-couplers 32 are interconnected in the perforating string 12 at various locations. In other examples, the shock de-couplers 32 could be used in other locations along a perforating string, other shock de-coupler quantities (including one) may be used, etc.

One of the shock de-couplers 32 is interconnected between two of the perforating guns 20. In this position, a shock de-coupler can mitigate the transmission of shock between perforating guns, and thereby prevent the accumulation of shock effects along a perforating string.

Another one of the shock de-couplers 32 is interconnected between the packer 26 and the perforating guns 20. In this position, a shock de-coupler can mitigate the transmission of shock from perforating guns to a packer, which could otherwise unset or damage the packer, cause damage to the tubular string between the packer and the perforating guns, etc. This shock de-coupler 32 is depicted in FIG. 1 as being positioned between the firing head 30 and the packer 26, but in other examples it may be positioned between the firing head and the perforating guns 20, etc.

Yet another of the shock de-couplers 32 is interconnected above the packer 26. In this position, a shock de-coupler can mitigate the transmission of shock from the perforating string 12 to a tubular string 34 (such as a production or injection tubing string, a work string, etc.) above the packer 26.

At this point, it should be noted that the well system 10 of FIG. 1 is merely one example of an unlimited variety of different well systems which can embody principles of this disclosure. Thus, the scope of this disclosure is not limited at all to the details of the well system 10, its associated methods, the perforating string 12, etc. described herein or depicted in the drawings.

For example, it is not necessary for the wellbore 14 to be vertical, for there to be two of the perforating guns 20, or for the firing head 30 to be positioned between the perforating guns and the packer 26, etc. Instead, the well system 10 configuration of FIG. 1 is intended merely to illustrate how the principles of this disclosure may be applied to an example perforating string 12, in order to mitigate the effects of a perforating event. These principles can be applied to many other examples of well systems and perforating strings, while remaining within the scope of this disclosure.

The shock de-couplers 32 are referred to as "de-couplers," since they function to prevent, or at least mitigate, coupling of shock between components connected to opposite ends of the de-couplers. In the example of FIG. 1, the coupling of shock is mitigated between perforating string 12 components, including the perforating guns 20, the firing head 30, the packer 26 and the tubular string 34. However, in other examples, coupling of shock between other components and other combinations of components may be mitigated, while remaining within the scope of this disclosure.

To prevent coupling of shock between components, it is desirable to allow the components to displace relative to one another, so that shock is reflected, instead of being coupled to the next perforating string components. However, as in the well system 10, it is also desirable to interconnect the components to each other in a predetermined configuration, so that the components can be conveyed to preselected positions in the wellbore 14 (e.g., so that the perforations 22 are formed where desired, the packer 26 is set where desired, etc.).

In examples of the shock de-couplers 32 described more fully below, the shock de-couplers can mitigate the coupling of shock between components, and also provide for accurate positioning of assembled components in a well. These otherwise competing concerns are resolved, while still permitting bidirectional displacement of the components relative to one another.

The addition of relatively compliant de-couplers to a perforating string can, in some examples, present a trade-off between shock mitigation and precise positioning. However, in many circumstances, it can be possible to accurately predict the deflections of the de-couplers, and thereby account for these deflections when positioning the perforating string in a wellbore, so that perforations are accurately placed.

By permitting relatively high compliance displacement of the components relative to one another, the shock de-couplers 32 mitigate the coupling of shock between the components, due to reflecting (instead of instead of transmitting or coupling) a substantial amount of the shock. The initial, relatively high compliance (e.g., greater than $1\times10^{-5}$ in/lb (~$5.71\times10^{-8}$ m/N), and more preferably greater than $1\times10^{-4}$ in/lb (~$5.71\times10^{-7}$ m/N) compliance) displacement allows shock in a perforating string component to reflect back into that component. The compliance can be substantially decreased, however, when a predetermined displacement amount has been reached.

Figure 2:
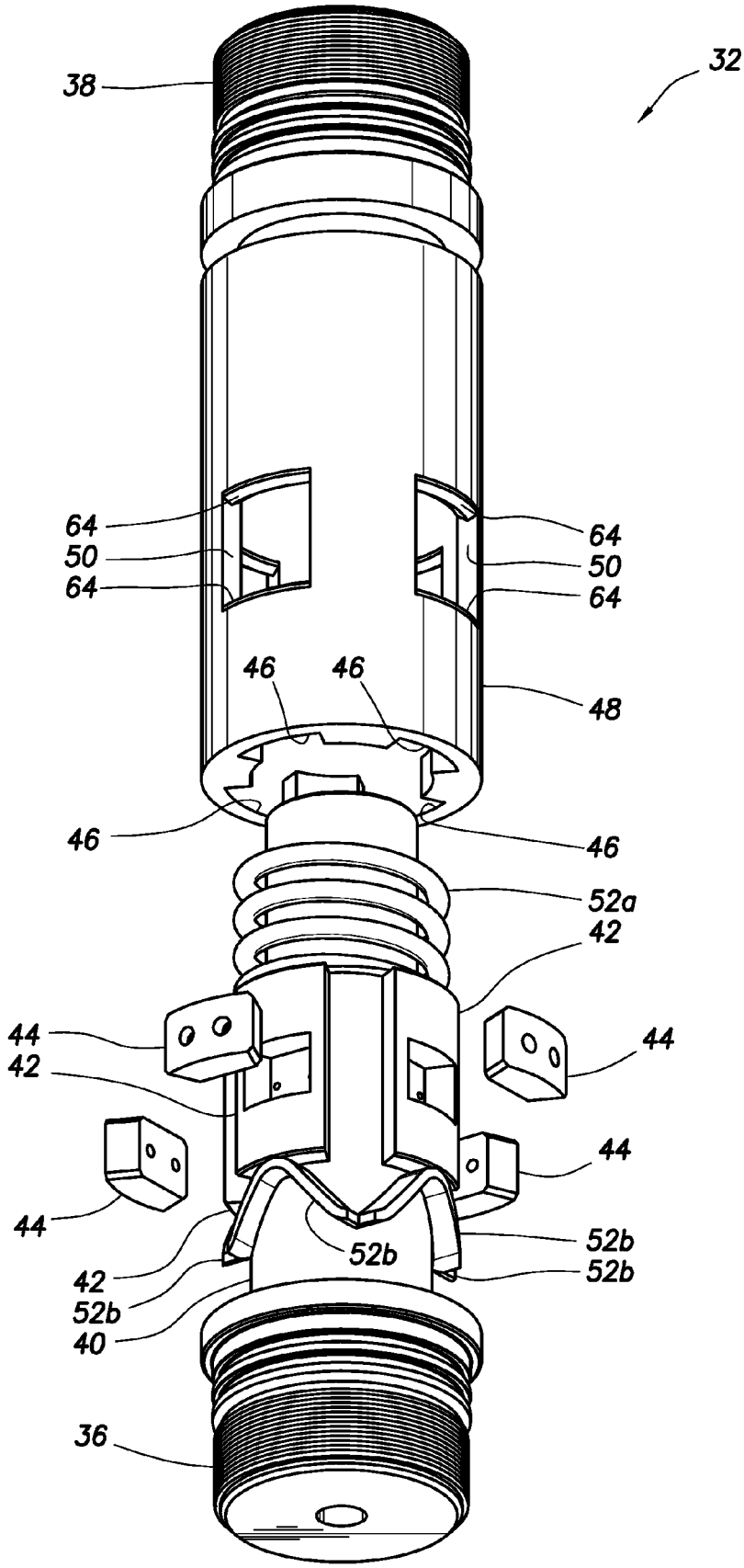
FIG. 2 is a representative exploded view of a shock de-coupler which may be used in the system and method of FIG. 1, and which can embody principles of this disclosure.

Referring additionally now to FIG. 2, an exploded view of one example of the shock de-couplers 32 is representatively illustrated. The shock de-coupler 32 depicted in FIG. 2 may be used in the well system 10, or it may be used in other well systems, in keeping with the scope of this disclosure.

In this example, perforating string connectors 36, 38 are provided at opposite ends of the shock de-coupler 32, thereby allowing the shock de-coupler to be conveniently interconnected between various components of the perforating string 12. The perforating string connectors 36, 38 can include threads, elastomer or non-elastomer seals, metal-to-metal seals, and/or any other feature suitable for use in connecting components of a perforating string.

An elongated mandrel 40 extends upwardly (as viewed in FIG. 2) from the connector 36. Multiple elongated generally rectangular projections 42 are circumferentially spaced apart on the mandrel 40. Additional generally rectangular projections 44 are attached to, and extend outwardly from the projections 42.

The projections 42 are complementarily received in longitudinally elongated slots 46 formed in a generally tubular housing 48 extending downwardly (as viewed in FIG. 2) from the connector 38. When assembled, the mandrel 40 is reciprocably received in the housing 48, as may best be seen in the representative cross-sectional view of FIG. 3.

The projections 44 are complementarily received in slots 50 formed through the housing 48. The projections 44 can be installed in the slots 50 after the mandrel 40 has been inserted into the housing 48.

The cooperative engagement between the projections 44 and the slots 50 permits some relative displacement between the connectors 36, 38 along a longitudinal axis 54, but prevents any significant relative rotation between the connectors. Thus, torque can be transmitted from one connector to the other, but relative displacement between the connectors 36, 38 is permitted in both opposite longitudinal directions.

Biasing devices 52*a, b* operate to maintain the connector 36 in a certain position relative to the other connector 38. The biasing device 52*a* is retained longitudinally between a shoulder 56 formed in the housing 48 below the connector 38 and a shoulder 58 on an upper side of the projections 42, and the biasing devices 52*b* are retained longitudinally between a shoulder 60 on a lower side of the projections 42 and shoulders 62 formed in the housing 48 above the slots 46.

Figure 3:
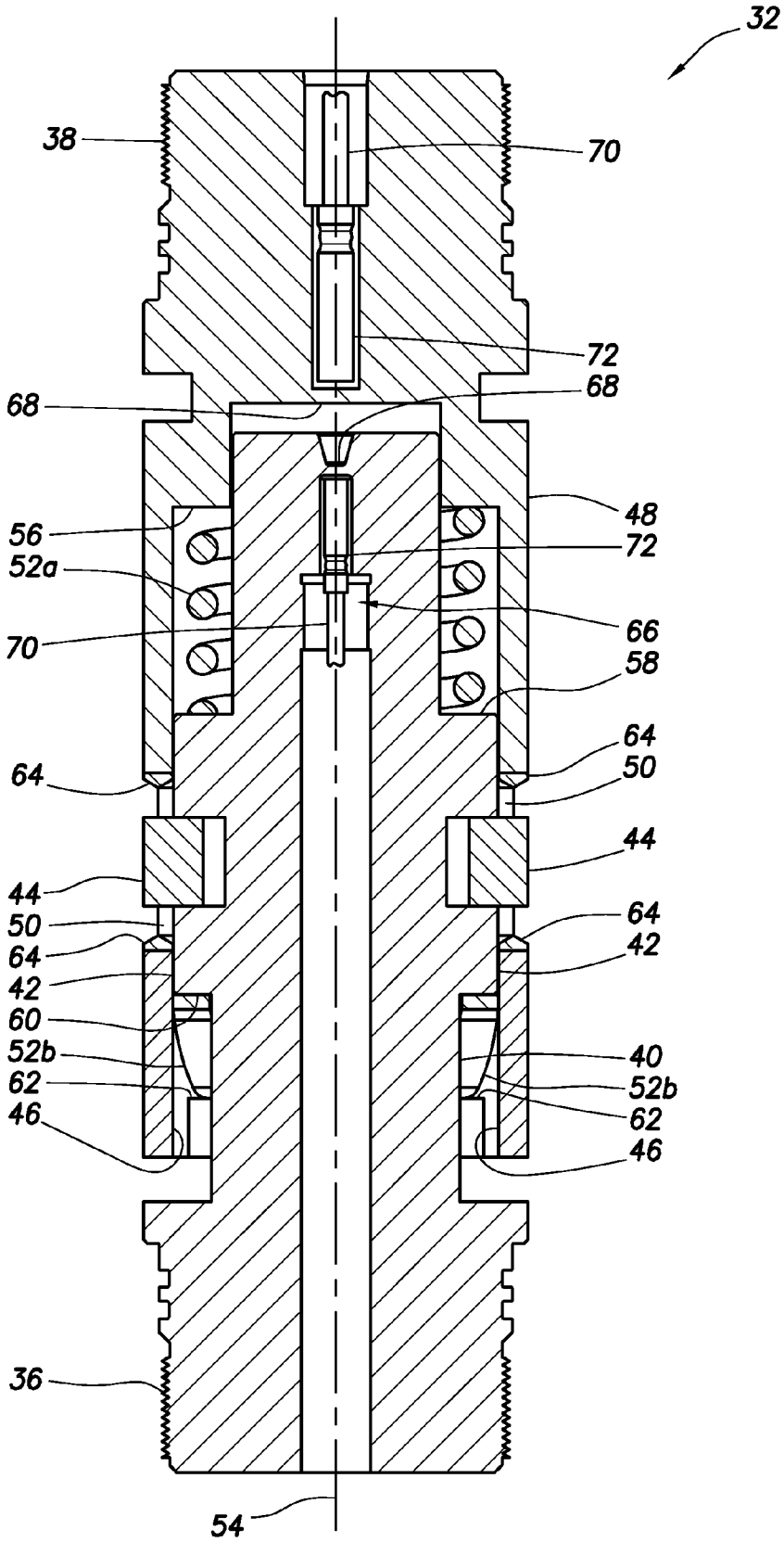
FIG. 3 is a representative cross-sectional view of the shock de-coupler.

Although the biasing device 52*a* is depicted in FIGS. 2 & 3 as being a coil spring, and the biasing devices 52*b* are depicted as partial wave springs, it should be understood that any type of biasing device could be used, in keeping with the principles of this disclosure. Any biasing device (such as a compressed gas chamber and piston, etc.) which can function to substantially maintain the connector 36 at a predetermined position relative to the connector 38, while allowing at least a limited extent of rapid relative displacement between the connectors due to a shock event (without a rapid increase in force transmitted between the connectors, e.g., high compliance) may be used.

Note that the predetermined position could be "centered" as depicted in FIG. 3 (e.g., with the projections 44 centered in the slots 50), with a substantially equal amount of relative displacement being permitted in both longitudinal directions. Alternatively, in other examples, more or less displacement could be permitted in one of the longitudinal directions.

Energy absorbers 64 are preferably provided at opposite longitudinal ends of the slots 50. The energy absorbers 64 preferably prevent excessive relative displacement between the connectors 36, 38 by substantially decreasing the effective compliance of the shock de-coupler 32 when the connector 36 has displaced a certain distance relative to the connector 38.

Examples of suitable energy absorbers include resilient materials, such as elastomers, and non-resilient materials, such as readily deformable metals (e.g., brass rings, crushable tubes, etc.), non-elastomers (e.g., plastics, foamed materials, etc.) and other types of materials. Preferably, the energy absorbers 64 efficiently convert kinetic energy to heat and/or mechanical deformation (elastic and plastic strain). However, it should be clearly understood that any type of energy absorber may be used, while remaining within the scope of this disclosure.

In other examples, the energy absorber 64 could be incorporated into the biasing devices 52*a, b*. For example, a biasing device could initially deform elastically with relatively high compliance and then (e.g., when a certain displacement amount is reached), the biasing device could deform plastically with relatively low compliance.

If the shock de-coupler 32 of FIGS. 2 & 3 is to be connected between components of the perforating string 12, with explosive detonation (or at least combustion) extending through the shock de-coupler (such as, when the shock de-coupler is connected between certain perforating guns 20, or between a perforating gun and the firing head 30, etc.), it may be desirable to have a detonation train 66 extending through the shock de-coupler.

It may also be desirable to provide one or more pressure barriers 68 between the connectors 36, 38. For example, the pressure barriers 68 may operate to isolate the interiors of perforating guns 20 and/or firing head 30 from well fluids and pressures.

In the example of FIG. 3, the detonation train 66 includes detonating cord 70 and detonation boosters 72. The detonation boosters 72 are preferably capable of transferring detonation through the pressure barriers 68. However, in other examples, the pressure barriers 68 may not be used, and the detonation train 66 could include other types of detonation boosters, or no detonation boosters.

Note that it is not necessary for a detonation train to extend through a shock de-coupler in keeping with the principles of this disclosure. For example, in the well system 10 as depicted in FIG. 1, there may be no need for a detonation train to extend through the shock de-coupler 32 connected above the packer 26.

Figure 4:
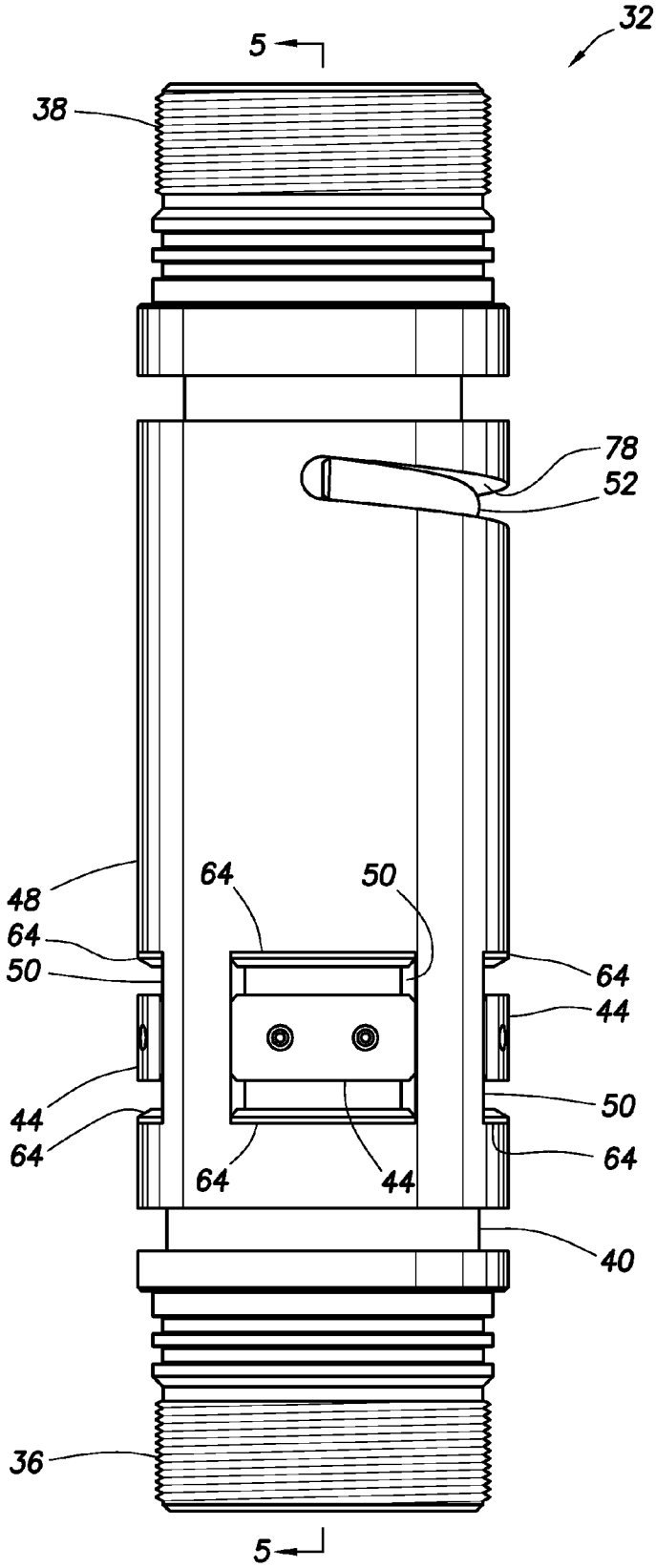
FIG. 4 is a representative side view of another configuration of the shock de-coupler.
Figure 5:
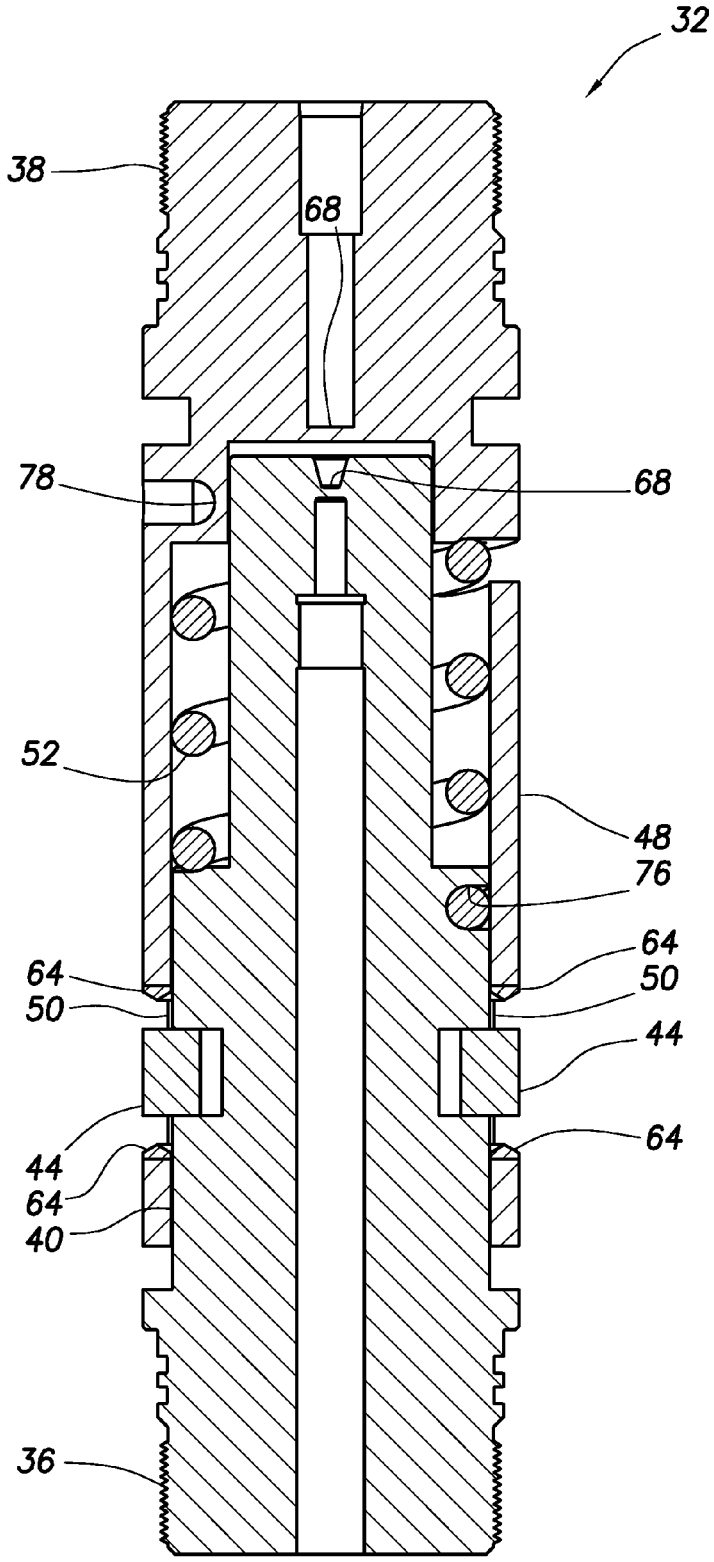
FIG. 5 is a representative cross-sectional view of the shock de-coupler, taken along line 5-5 of FIG. 4.

Referring additionally now to FIGS. 4 & 5, another configuration of the shock de-coupler 32 is representatively illustrated. In this configuration, only a single biasing device 52 is used, instead of the multiple biasing devices 52*a, b* in the configuration of FIGS. 2 & 3.

One end of the biasing device 52 is retained in a helical recess 76 on the mandrel 40, and an opposite end of the biasing device is retained in a helical recess 78 on the housing 48. The biasing device 52 is placed in tension when the connector 36 displaces in one longitudinal direction relative to the other connector 38, and the biasing device is placed in compression when the connector 36 displaces in an opposite direction relative to the other connector 38. Thus, the biasing device 52 operates to maintain the predetermined position of the connector 36 relative to the other connector 38.

Figure 6:
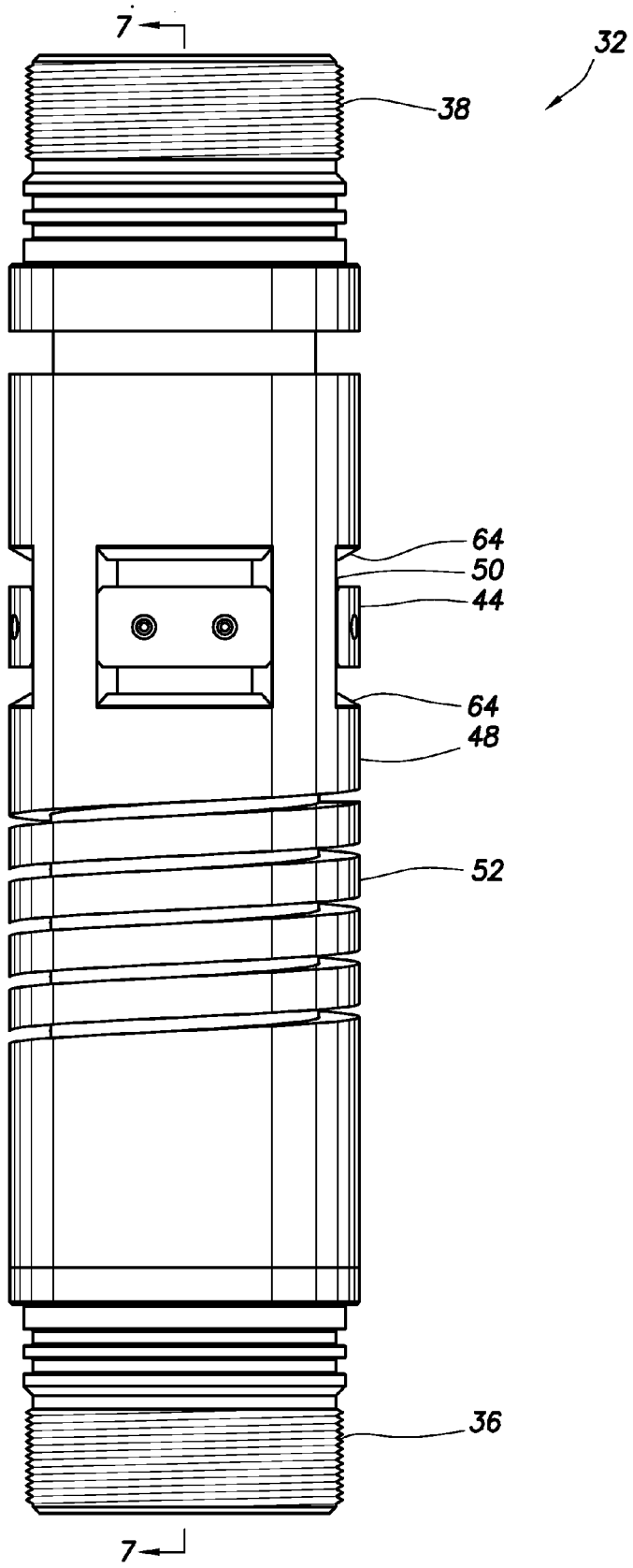
FIG. 6 is a representative side view of yet another configuration of the shock de-coupler.
Figure 7:
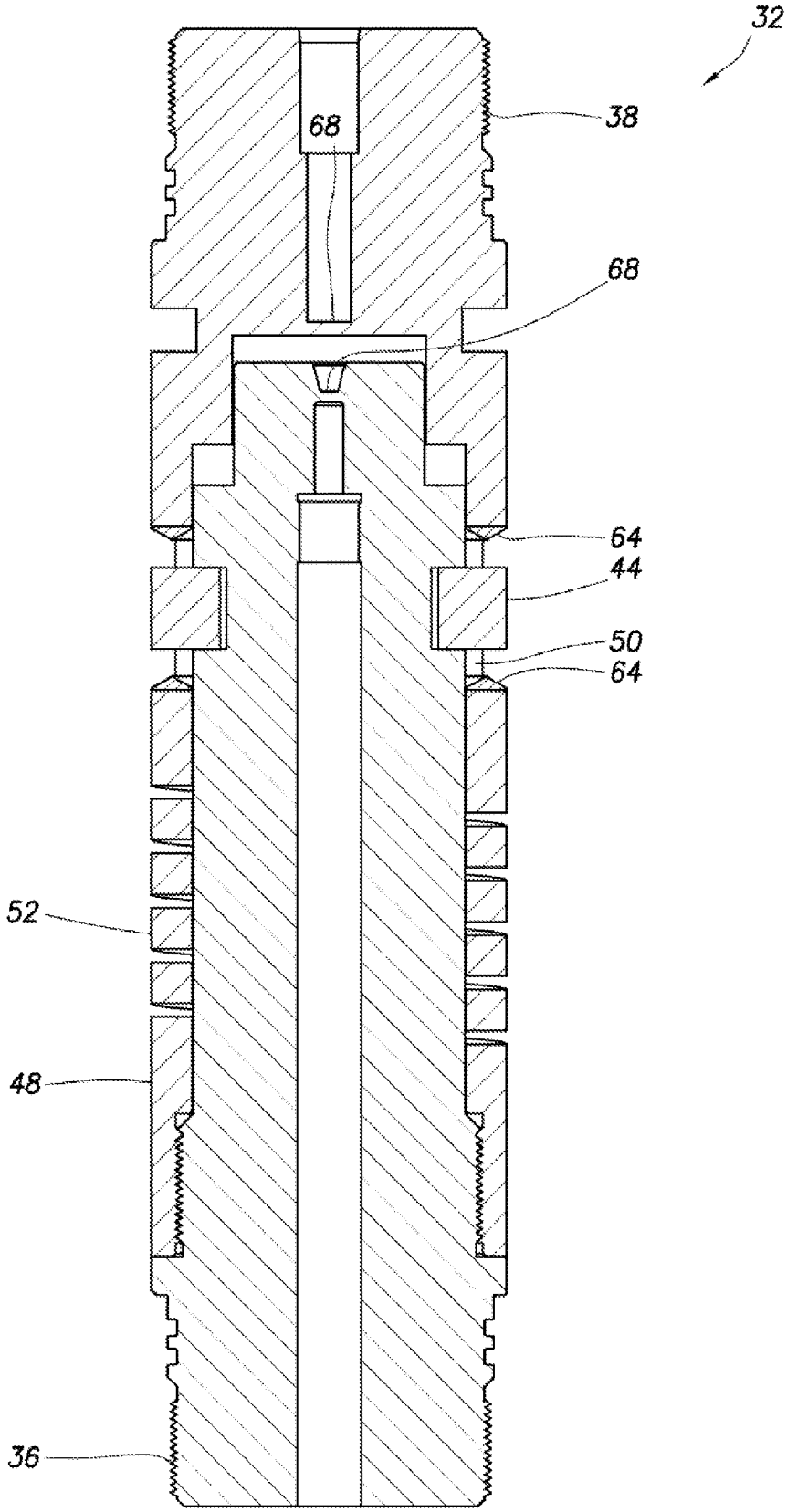
FIG. 7 is a representative cross-sectional view of the shock de-coupler, taken along line 7-7 of FIG. 6.

Referring additionally now to FIGS. 6 & 7 yet another configuration of the shock de-coupler 32 is representatively illustrated. This configuration is similar in many respects to the configuration of FIGS. 4 & 5, but differs at least in that the biasing device 52 in the configuration of FIGS. 6 & 7 is formed as a part of the housing 48.

In the FIGS. 6 & 7 example, opposite ends of the housing 48 are rigidly attached to the respective connectors 36, 38. The helically formed biasing device 52 portion of the housing 48 is positioned between the connectors 36, 38. In addition, the projections 44 and slots 50 are positioned above the biasing device 52 (as viewed in FIGS. 6 & 7).

Figure 9:
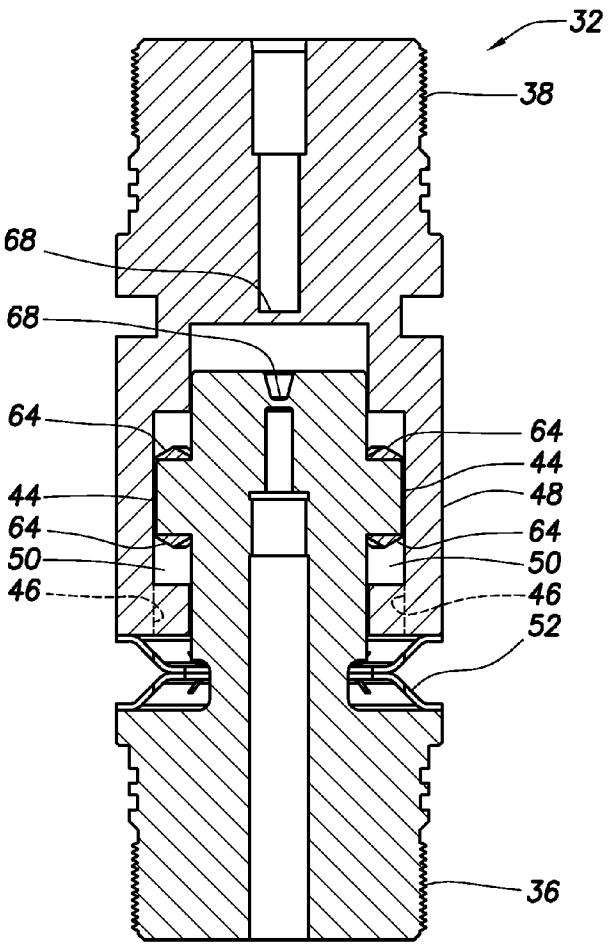
FIG. 9 is a representative cross-sectional view of the shock de-coupler, taken along line 9-9 of FIG. 8.
Figure 8:
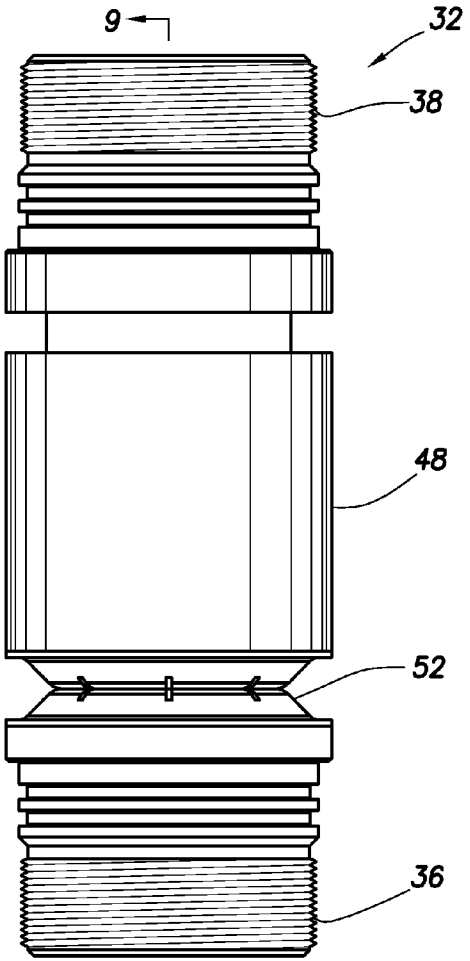
FIG. 8 is a representative side view of a further configuration of the shock de-coupler.

Referring additionally now to FIGS. 8 & 9, another configuration of the shock de-coupler 32 is representatively illustrated. This configuration is similar in many respects to the configuration of FIGS. 6 & 7, but differs at least in that the biasing device 52 is positioned between the housing 48 and the connector 36.

Opposite ends of the biasing device 52 are rigidly attached (e.g., by welding, etc.) to the respective housing 48 and connector 36. When the connector 36 displaces in one longitudinal direction relative to the connector 38, tension is applied across the biasing device 52, and when the connector 36 displaces in an opposite direction relative to the connector 38, compression is applied across the biasing device.

The biasing device 52 in the FIGS. 8 & 9 example is constructed from oppositely facing formed annular discs, with central portions thereof being rigidly joined to each other (e.g., by welding, etc.). Thus, the biasing device 52 serves as a resilient connection between the housing 48 and the connector 36. In other examples, the biasing device 52 could be integrally formed from a single piece of material, the biasing device could include multiple sets of the annular discs, etc.

Additional differences in the FIGS. 8 & 9 configuration are that the slots 50 are formed internally in the housing 48 (with a twist-lock arrangement being used for inserting the projections 44 into the slots 50 via the slots 46 in a lower end of the housing), and the energy absorbers 64 are carried on the projections 44, instead of being attached at the ends of the slots 50.

The biasing device 52 can be formed, so that a compliance of the biasing device substantially decreases in response to displacement of the first connector 36 a predetermined distance away from the predetermined position relative to the other connector 38. This feature can be used to prevent excessive relative displacement between the connectors 36, 38.

The biasing device 52 can also be formed, so that it has a desired compliance and/or a desired compliance curve.

This feature can be used to "tune" the compliance of the overall perforating string 12, so that shock effects on the perforating string are optimally mitigated. Suitable methods of accomplishing this result are described in International Application serial nos. PCT/US10/61104 (filed 17 Dec. 2010), PCT/US11/34690 (filed 30 Apr. 2011), and PCT/US11/46955 (filed 8 Aug. 2011). The entire disclosures of these prior applications are incorporated herein by this reference.

The examples of the shock de-coupler 32 described above demonstrate that a wide variety of different configurations are possible, while remaining within the scope of this disclosure. Accordingly, the principles of this disclosure are not limited in any manner to the details of the shock de-coupler 32 examples described above or depicted in the drawings.

It may now be fully appreciated that this disclosure provides several advancements to the art of mitigating shock effects in subterranean wells. Various examples of shock de-couplers 32 described above can effectively prevent or at least reduce coupling of shock between components of a perforating string 12.

In one aspect, the above disclosure provides to the art a shock de-coupler 32 for use with a perforating string 12. In an example, the de-coupler 32 can include first and second perforating string connectors 36, 38 at opposite ends of the de-coupler 32, a longitudinal axis 54 extending between the first and second connectors 36, 38, and at least one biasing device 52 which resists displacement of the first connector 36 relative to the second connector 38 in both of first and second opposite directions along the longitudinal axis 54, whereby the first connector 36 is biased toward a predetermined position relative to the second connector 38.

Torque can be transmitted between the first and second connectors 36, 38.

A pressure barrier 68 may be used between the first and second connectors 36, 38. A detonation train 66 can extend across the pressure barrier 68.

The shock de-coupler 32 may include at least one energy absorber 64 which, in response to displacement of the first connector 36 a predetermined distance, substantially increases force resisting displacement of the first connector 36 away from the predetermined position. The shock de-coupler 32 may include multiple energy absorbers which substantially increase respective forces biasing the first connector 36 toward the predetermined position in response to displacement of the first connector 36 a predetermined distance in each of the first and second opposite directions.

The shock de-coupler 32 may include a projection 44 engaged in a slot 50, whereby such engagement between the projection 44 and the slot 50 permits longitudinal displacement of the first connector 36 relative to the second connector 38, but prevents rotational displacement of the first connector 36 relative to the second connector 38.

The biasing device may comprise first and second biasing devices 52*a, b*. The first biasing device 52*a* may be compressed in response to displacement of the first connector 36 in the first direction relative to the second connector 38, and the second biasing device 52*b* may be compressed in response to displacement of the first connector 36 in the second direction relative to the second connector 38.

The biasing device 52 may be placed in compression in response to displacement of the first connector 36 in the first direction relative to the second connector 38, and the biasing device 52 may be placed in tension in response to displacement of the first connector 36 in the second direction relative to the second connector 38.

A compliance of the biasing device 52 may substantially decrease in response to displacement of the first connector 36 a predetermined distance away from the predetermined position relative to the second connector 38. The biasing device 52 may have a compliance of greater than about $1\times10^{-5}$ in/lb. The biasing device 52 may have a compliance of greater than about $1\times10^{-4}$ in/lb.

A perforating string 12 is also described by the above disclosure. In one example, the perforating string 12 can include a shock de-coupler 32 interconnected longitudinally between first and second components of the perforating string 12. The shock de-coupler 32 variably resists displacement of the first component away from a predetermined position relative to the second component in each of first and second longitudinal directions. A compliance of the shock de-coupler 32 substantially decreases in response to displacement of the first component a predetermined distance away from the predetermined position relative to the second component.

Examples of perforating string 12 components described above include the perforating guns 20, the firing head 30 and the packer 26. The first and second components may each comprise a perforating gun 20. The first component may comprise a perforating gun 20, and the second component may comprise a packer 26. The first component may comprise a packer 26, and the second component may comprise a firing head 30. The first component may comprise a perforating gun 20, and the second component may comprise a firing head 30. Other components may be used, if desired.

The de-coupler 32 may include at least first and second perforating string connectors 36, 38 at opposite ends of the de-coupler 32, and at least one biasing device 52 which resists displacement of the first connector 36 relative to the second connector 38 in each of the longitudinal directions, whereby the first component is biased toward the predetermined position relative to the second component.

The shock de-coupler 32 may have a compliance of greater than about $1\times10^{-5}$ in/lb. The shock de-coupler 32 may have a compliance of greater than about $1\times10^{-4}$ in/lb.

It is to be understood that the various embodiments of this disclosure described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. Accordingly, the foregoing detailed description is to be clearly understood as being given by way of illustration and example only, the spirit and scope of the invention being limited solely by the appended claims and their equivalents.

What is claimed is:

1. A shock de-coupler for use with a perforating string, the de-coupler comprising:

first and second perforating string connectors at opposite ends of the de-coupler, a longitudinal axis extending between the first and second connectors; and at least first and second biasing devices which resist displacement of the first connector relative to the second connector in both of first and second opposite directions along the longitudinal axis, whereby the first connector is biased toward a predetermined position relative to the second connector, wherein the first biasing device is compressed in response to displacement of the first connector in the first direction relative to the second connector, and the second biasing device is compressed in response to displacement of the first connector in the second direction relative to the second connector.

2. A shock de-coupler for use with a perforating string, the de-coupler comprising:

first and second perforating string connectors at opposite ends of the de-coupler, a longitudinal axis extending between the first and second connectors; and at least one biasing device which resists displacement of the first connector relative to the second connector in both of first and second opposite directions along the longitudinal axis, whereby the first connector is biased toward a predetermined position relative to the second connector, wherein the biasing device is placed in compression in response to displacement of the first connector in the first direction relative to the second connector, wherein the biasing device is placed in tension in response to displacement of the first connector in the second direction relative to the second connector, and wherein the first connector is prevented from rotating relative to the second connector.

3. A shock de-coupler for use with a perforating string, the de-coupler comprising:

first and second perforating string connectors at opposite ends of the de-coupler, a longitudinal axis extending between the first and second connectors; and at least one biasing device which resists displacement of the first connector relative to the second connector in both of first and second opposite directions along the longitudinal axis, whereby the first connector is biased toward a predetermined position relative to the second connector, and wherein a compliance of the biasing device substantially decreases in response to displacement of the first connector a predetermined distance toward the second connector.

4. A perforating string, comprising:

a shock de-coupler interconnected longitudinally between first and second components of the perforating string, wherein the shock de-coupler variably resists displacement of the first component away from a predetermined position relative to the second component in each of first and second longitudinal directions, wherein a compliance of the shock de-coupler substantially decreases in response to displacement of the first component a predetermined distance away from the predetermined position relative to the second component, wherein the de-coupler comprises at least first and second perforating string connectors at opposite ends of the de-coupler, and at least first and second biasing devices which resist displacement of the first connector relative to the second connector in each of the longitudinal directions, whereby the first component is biased toward the predetermined position relative to the second component, and wherein the first biasing device is compressed in response to displacement of the first connector in the first direction relative to the second connector, and the second biasing device is compressed in response to displacement of the first connector in the second direction relative to the second connector.

5. A perforating string, comprising:

a shock de-coupler interconnected longitudinally between first and second components of the perforating string, wherein the shock de-coupler variably resists displacement of the first component away from a predetermined position relative to the second component in each of first and second longitudinal directions, wherein a compliance of the shock de-coupler substantially decreases in response to displacement of the first component a predetermined distance away from the predetermined position relative to the second component, wherein the de-coupler comprises at least first and second perforating string connectors at opposite ends of the de-coupler, and at least one biasing device which resists displacement of the first connector relative to the second connector in each of the longitudinal directions, whereby the first component is biased toward the predetermined position relative to the second component, wherein the biasing device is placed in compression in response to displacement of the first connector in the first direction relative to the second connector, wherein the biasing device is placed in tension in response to displacement of the first connector in the second direction relative to the second connector, and wherein the first connector is prevented from rotating relative to the second connector.

* * * * *